United States Patent [19]

Iwamuro et al.

[11] Patent Number: 4,477,559

[45] Date of Patent: Oct. 16, 1984

[54] PHOTOSENSITIVE SILVER HALIDE COLOR PHOTOGRAPHIC MATERIALS

[75] Inventors: Masao Iwamuro, Hachioji; Kenji Kumashiro, Hino, both of Japan

[73] Assignee: Konishiroku Photo Industry Co., Ltd., Tokyo, Japan

[21] Appl. No.: 468,399

[22] Filed: Feb. 22, 1983

[30] Foreign Application Priority Data

Feb. 25, 1982 [JP] Japan ..... 57-30392

[51] Int. Cl.[3] ..... G03C 1/46

[52] U.S. Cl. ..... 430/505; 430/506; 430/507; 430/513; 430/517

[58] Field of Search ..... 430/505, 507, 510, 513, 430/517, 506

[56] References Cited

U.S. PATENT DOCUMENTS 1,971,430 8/1934 Schneider ..... 430/510
2,755,186 7/1956 Saner ..... 430/517
3,392,021 7/1968 McGuckin ..... 430/510
3,434,839 3/1969 McGuckin ..... 430/517
3,778,273 12/1973 Gernert et al. ..... 430/517

*Primary Examiner*—J. Travis Brown

*Attorney, Agent, or Firm*—Frishauf, Holtz, Goodman & Woodward

[57] ABSTRACT

There is disclosed a photosensitive silver halide color photographic material comprising a support having on one side thereof, an antihalation layer, a red-sensitive silver halide emulsion layer, a green-sensitive silver halide emulsion layer and a blue-sensitive silver halide emulsion layer wherein each of said silver halide emulsion layers contains a non-diffusable coupler. The other surface of the support has thereon a dye-containing backing layer. The antihalation layer contains no more than 0.2 $g/m^2$ of silver and the total amount of silver contained in the silver halide emulsion layers is at least 7.0 $g/m^2$.

8 Claims, No Drawings

PHOTOSENSITIVE SILVER HALIDE COLOR PHOTOGRAPHIC MATERIALS

This invention relates to photosensitive silver halide color photographic materials (hereinafter simply called "photosensitive materials") and more particularly to photosensitive materials which have been improved in sharpness of color photographic images obtained therefrom as well as in removability therefrom of silver in the weak bleaching treatment thereof.

To obtain photosensitive materials of high quality, there have been made various proposals with the purpose of attaining high sensitivity and fine graininess in recent years. For instance, British Pat. No. 923,045 discloses a procedure in which high and low sensitive emulsion layers in the photosensitive material are coated separate from each other, or Japanese Patent Publn. No. 15495/1974 and Japanese Patent Laid-Open-to-Public Publn. No. 7230/1978 disclose similar procedures in which a medially sensitive emulsion layer is provided between high and low sensitive emulsion layers. Furthermore, Japanese Patent Laid-Open-to-Public Publn. No. 155536/1982 proposes a procedure in which an intermediate layer is provided between high and low sensitive emulsion layers, said intermediate layer being incorporated with coupler. In addition thereto, there are known procedures for attaining high sensitivity and fine graininess in the photosensitive materials by the use of coarse silver halide crystals particularly in high sensitive emulsion layers, or by dispersing colored cloud which is formed with increasing amount of the silver used. Certainly the effectiveness in attaining high sensitivity or fine graininess as desired is observed in the procedure disclosed in the aforesaid Japanese Patent Laid-Open-to-Public Publn. No. 7230/1978 or Japanese Patent Laid-Open-to-Public Publn. No. 155536/1982, however, there is involved such problem that the number of emulsion layers or non-emulsion layers increases owing to complicated layer construction as required and, as a natural consequence, this leads to a substantial increase in thickness of the photosensitive materials thereby obtained or in amount of the silver used therein.

On the one hand, moreover, photographic processing of color photosensitive materials at high temperatures and high speed has increasingly come to be carried out. In this connection, processes of color development and desilverization are the operational fundamentals of the photographic processing of color photosensitive materials.

Of known procedures heretofore adopted in the aforesaid desilverizing process, the one is that which comprises oxidizing silver image or colloidal silver with a treatment agent consisting essentially of sodium ferricyanide to corresponding silver halide, treating the resulting silver halide with sodium thiosulfate or a fixing solution consisting essentially of ammonium thiosulfate to make said silver halide water-soluble, and removing the thus treated silver halide by dissolving it in water, and the other is that which comprises oxidizing silver image or colloidal silver with ferric salt of aminopolycarboxylic acid, e.g. iron (II) ammonium salt of ethylenediaminetetraacetic acid, and removing the resulting silver halide by the use of the aforesaid fixing solution.

The former procedure relying on the treatment using principally sodium ferricyanide generally exhibits strong desilverizing effect, but, on the contrary, has such serious drawbacks that apparatus and instrument used in this procedure are required in most cases to be made of special materials resistant to the treatment agent which is strongly corrosive, and particularly that this procedure is of little real use at present, except for special cases, since the practice of the procedure in a commercial scale will lead to the provoking cause of environmental pollution, i.e. public hazard to which keep public interest has been drawn recently. Under such circumstances, recently the bleaching solution consisting essentially of iron (II) salt of aminopolycarboxylic acid has come to play the leading role in the practice of the desilverizing process. In that case, however, the problem which is unavoidably associated with this desilverizing process is such that because iron (II) salt of aminopolycarboxylic acid is relatively weak in desilverizing power, it becomes necessary to use expensive iron (II) salt of aminopolycarboxylic acid in large amounts or prolong the bleaching time in order to obtain sufficient desilverizing power.

Because of their having high silver content or large thickness, high sensitive and fine-granificated photosensitive materials which may be seen in the aforementioned Japanese Patent Laid-Open-to-Public Publn. No. 7230/1978 or Japanese Patent Laid-Open-to-Public Publn. No. 155536/1982 possess in most cases such drawback that when they are treated with a bleaching solution containing iron (II) salt of aminopolycarboxylic acid which is weak in oxidizing power, the silver present in the photosensitive materials treated under usual treatment conditions is not completely oxidized and remains, as it is, in the treated photosensitive materials after completion of the treatment. Extensive investigations conducted by the present inventors on the above-mentioned phenomenon observed in the photosensitive materials containing large amounts of silver lead to the following discovery. That is, the lower is the position at which the photosensitive layer is provided, the slower is the rate of bleaching, and particularly a marked tendency to this phenomenon is observed in the case of black colloidal silver contained in the antihalation layer. With the purpose of obviating such residual silver image or colloidal silver found in the processed photosensitive materials, i.e. insufficient desilverization, there have heretofore been proposed various techniques such as addition of desilverization accelerators, reduction in thickness of photosensitive material and realization of silver-saved type photosensitive material. In spite of these efforts, however, no successful development of high sensitive and fine-grainificated photosensitive materials improved in desilverizing property has been attained yet. In addition thereto, there is known a measure for effectively improving the above-mentioned insufficient desilverization, wherein the amount of black colloidal silver used in an antihalation layer interposed between a support and an emulsion layer is reduced. In this measure, however, if the amount of black colloidal silver used is less than a certain level, the expected antihalation effect decreases to give undesirable results from the viewpoint of sharpness of the resulting images. Alternatively, the aforesaid insufficient desilverization may be improved by providing a backing layer on the reverse of a support while omitting an antihalation layer to be provided on the surface of said support. In this case, however, the antihalation effect attainable is markedly low in comparison with that of an antihalation layer containing black colloidal silver interposed between a support and an emulsion layer.

Accordingly, a primary object of the present invention is to provide high sensitive and fine-grainificated photosensitive materials which have been improved in desilverizing property. A secondary object of the present invention is to provide high sensitive and fine-grainificated photosensitive materials which have been improved in sharpness of images obtained thereon.

The present inventors prosecuted extensive researches with the view of solving the aforementioned problems and have eventually found that the problems can be solved and the abovementioned objects of the present invention are accomplished by designing a photosensitive material in such a manner that the photosensitive material has on one side of a support an antihalation layer containing colloidal silver, the silver content of which being less than 0.2 g/m$^2$, and on the other side of said support a dye containing backing layer, and a blue-sensitive silver halide emulsion layer, green-sensitive silver halide emulsion layer and red-sensitive silver halide emulsion layer to the side of said antihalation layer, said blue-sensitive, green-sensitive and red-sensitive layers each containing non-diffuse coupler, the total silver content of all photosensitive silver halide emulsion layers as aforesaid being at least 7.0 g/m$^2$.

In the photosensitive silver halide emulsion layers in accordance with the present invention, every one of given color-sensitive layers may be formed as a single layer or, if necessary, as a combination of two or more layers. The effect as expected in the photosensitive materials of the present invention can sufficiently be exhibited in a successful manner by those comprising given color-sensitive emulsion layers, each having been formed as a combination of three or more layers, and in more successful manner by those comprising given color-sensitive layers, each having been formed as a combination of three or more layers having interposed non-photosensitive layers therebetween.

Black colloidal silver used in the present invention may be prepared by reducing silver nitrate in the presence of such binder as typified by gelatin with hydroquinone or such phenol as pyrogallol or tannin in place thereof.

Usable as dyes in the present invention are such oxonol dyes having pyrazolone nucleus as disclosed in British Pat. No. 506,385, Japanese Patent Publns. Nos. 22069/1964 and 13168/1968, and Japanese Patent Laid-Open-to-Public Publn. No. 85130/1973; such oxonol dyes having barbituric acid nucleus as disclosed in U.S. Pat. Nos. 3,247,127 and 3,653,905; such oxonol dyes other than those mentioned above as disclosed in U.S. Pat. No. 2,533,472, British Pat. No. 1,278,621 and French Pat. No. 1,401,588; such benzylidene (or cinnamylidene) pyrazolone dyes as disclosed in British Pat. No. 584,609, U.S. Pat. Nos. 3,540,887, 3,615,546 and 3,687,670, French Pat. Nos. 1,350,311 and 1,421,679; such stylyl dyes as disclosed in U.S. Pat. Nos. 2,298,733, 2,622,082, 3,384,487 and 3,652,283, British Pat. No. 1,075,653, and Belgian Pat. No. 733,124; such merocyanine dyes as disclosed in British Pat. Nos. 1,075,653 (only those of the general formula II), 1,153,341 and 1,284,730, and French Pat. No. 1,401,588 (only those of the general formula I); and such cyanine dyes as disclosed in U.S. Pat. Nos. 2,843,486 and 3,294,539, and British Pat. No. 1,075,653 (only those of the general formulas I and II).

These dyes usable in the present invention may be employed either singly or in combination of two or more, if necessary. The amount of dye used may vary according to the kind of the dye employed. Generally, however, the concentration of dye is preferably 1-1000 mg per square meter of photosensitive material.

The photosensitive materials of the present invention are intended to include color negative film, color positive film, so-called inner or outer type color reversal film, color aerophotographic film, color X-ray film, photosensitive material for color diffusion transfer process or photosensitive material for silver dye bleaching process.

Silver halides used in the present invention may be any of those commonly used ordinary silver halide photographic emulsions, such as silver chloride, silver bromide, silver iodide, silver chloroiodide, silver iodobromide and silver chloroiodobromide and mixtures thereof. These silver halide crystals may of coarse or fine, and particle size distribution thereof amy be narrow or wide. The silver halide crystals may be either regular crystal or twinned, and the ratio of [100] to [111] face may optionally selected. These silver halide crystals may have uniform crystal habit from inner through outer portion of crystal, or may have the inner and outer portions of crystal different habit in their stratified form. These silver halides may be any of the types, forming latent image mainly on the surface or in the interior thereof. The silver halide crystals can be prepared by any of the well-known procedures conventionally employed in the art.

The silver halides used in the present invention are dispersed generally in gelatin as a binder. In that case, however, such polymers as polyvinyl alcohol may be used in place of gelatin, or the polymers may be used in admixture with gelatin. Silver halide emulsions being the despersion of these silver halides in an appropriate binder can be chemically sensitized.

Chemical sensitization of the silver halides used in the present invention is performed according to any of the conventional procedures heretofore adopted in the art. That is, the silver halides can be chemically sensitized with chemical sensitizers used either alone or in combination, such as active gelatin, noble metal sensitizers, e.g. water-soluble gold salts, water-soluble platinum salts, water-soluble palladium salts, water-soluble rhodium salts, and water-soluble iridium salts, sulfur sensitizers, selenium sensitizers and reduction sensitizers, e.g. polyamines and cuprous chloride. Furthermore, these silver halide can be optically sensitized (e.g. supersensitization) to desired wavelength regions with optical sensitizers, for example, cyanine dyes such as zeromethine dyes, monomethine dyes, dimethine dyes and trimethine dyes, or merocyanine dyes.

In the photosensitive materials of the present invention, at least one of photosensitive layers and other constituent layers (e.g. intermediate layer, sub layer, filter layer, protective layer, image-receiving layer, etc.) contain, according to the purpose, various photographic additives. Photographic additives usable in the present invention include, for example, stabilizers or antifoggants such as azaindenes, triazoles, tetrazoles, imidazolium salts, tetrazolium salts and polyhydroxy compounds; hardeners of such types as aldehyde, aziridine, isooxazole, vinyl sulfone, acryloyl, carbodiimide, maleimide, methanesulfonic acid ester, and triazine; gradation agents such as metals belonging to Group VIII of the periodic table (e.g. rhodium and ruthenium), cadmium or thallium; development accelerators such as benzyl alcohol and polyoxyethylene type compounds; image stabilizers of such types as chroman, coumaran, bisphenol, and phosphorous acid ester; and lubricants such as wax, glycerides of higher fatty acid and higher alcohol esters of higher fatty acids.

Furthermore, various surface active agents, such as anionic, cationic, nonionic or amphoteric surfactants are usable as coating aids, emulsifiers, agents for improving permeability through processing solutions, etc., defoaming agents, or materials for controlling various physical properties of the photosensitive materials. Advantageously useful mordants include N-guanylhydrazone type compounds, quaternary onium salt compounds, etc. Useful antistatic agents are alkali salts of reaction products of p-aminobenzenesulfonic acid with diacetylcellulose, styreneperfluoroalkyllithium maleate copolymer or styrene-maleic anhydride copolymer. Usable as color turbidity preventives are polymers containing vinylpyrrolidone monomer and polymers containing vinylimidazole monomer. Useful matting agents include methyl polymethacrylate, polystyrene and alkali-soluble polymers, and colloidal silicon oxide is also usable. As latex used for improving physical properties of coating film, there may be mentioned such copolymers of acrylic ester or vinyl ester and other monomers having ethylene group.

Gelatin-plasticizing agents may include glycerin, glycol type compounds, etc., and viscosity-increasing agents may include styrenesodium maleate copolymers, alkyl vinyl ethermaleic acid copolymers, etc.

In the silver halide photosensitive materials of the present invention, there can be used such couplers as mentioned hereinafter.

Open chain ketomethylene compounds have heretofore been used as yellow couplers, and in the present invention, there may be used benzoylacetoanilide type yellow couplers and pivaroylacetoanilide type yellow couplers which are widely adopted in photosensitive silver halide color photographic materials in general.

Furthermore, 2-equivalent couplers in which the carbon atom at the coupling position has been substituted with a substituent capable of being released at the time of coupling reaction may also be used as yellow couplers. Yellow couplers which are useful in the present invention are exemplified below.

(Y1) α-(4-Carboxyphenoxy)-α-pivalyl-2-chloro-5-[δ-(2,4-di-tert-amylphenoxy)butylamido]acetoanilide
(Y2) α-Pivalyl-2-chloro-5-[δ-(2,4-di-tert-amylphenoxy)butylamido]acetoanilide
(Y3) α-Benzoyl-2-chloro-5-[α-(dodecyloxycarboxyl-)ethoxycarbonyl]acetoanilide
(Y4) α-(4-Carboxyphenoxy)-α-pivaryl-2-chloro-5-[α-(3-pentadecylphenoxy)butylamido]acetoanilide
(Y5) α-(1-Benzyl-2,4-dioxo-imidazolidine-3-il)-α-pivaryl-2-chloro-5-[γ-(2,4-di-tert-amylphenoxy)-butylamido]acetoanilide
(Y6) α-Pivalyl-α-(1-benzyl-2-phenyl-3,5-dioxotriazolidine-4-il)-2-chloro-5'-[γ-(2,4-di-tert-amylphenoxy)butylamido]acetoanilide
(Y7) α-Benzoyl-α-[1,2-di-(4-tert-butylbenzyl)-3,5-dioxotriazolidine-4-il]-3'-[α-(2,4-di-tert-amylphenoxy)butylamido]acetoanilide
(Y8) α-Pivalyl-α-(1-benzyl-2-phenyl-3,5-dioxotriazolidine-4-il)-2'-chloro-5'-[α-(dodecycloxycarbonyl)ethoxycarbonyl]acetoanilide Usable as magenta couplers in the present invention are pyrazolone, pyrazolotriazole, pyrazolinobenzimidazole and indazolone type compounds. Magenta couplers which are useful in the present invention are exemplified below.

(M1) 1-(2,4,6-Trichlorophenyl)-3-[3-(2,4-di-tert-amylphenoxyacetamido)benzamido]-5-pyrazolone
(M2) 1-(2,4,6-trichlorophenyl)-3-(3-dodecylsuccinimidobenzamido)-5-pyrazolone
(M3) 4,4'-methylenebis{1-(2,4,6-trichlorophenyl)-3-[3-(2,4-di-tert-amylphenoxyacetamido)benzamido]}-5-pyrazolone
(M4) 1-(2,4,6-trichlorophenyl)-3-(2-chloro-5-octadecylsuccinimidoanilino)-5-pyrazolone
(M5) 1-(2-Chloro-4,6-dimethylphenyl)-3-{3-[α-(3-pentadecylphenoxy)butylamido]benzamido}-5-pyrazolone
(M6) 1-(2,4,6-Trichlorophenyl)-3-(2-chloro-5-octadecylcarbamoylanilino)-5-pyrazolone
(M7) 3-Ethoxy-1-{4-[α-(3-pentadecylphenoxy)-butylamido]phenyl}-5-pyrazolone
(M8) 1-(2,4,6-Trichlorophenyl)-3-(2-chloro-5-tetradecaneamidoanilino)-5-pyrazolone Usable as cyan couplers in the present invention are generally phenol or naphthol derivatives. Cyan couplers which may be used in the present invention are exemplified below.

(C1) 1-Hydroxy-N-[δ-(2,4-di-tert-amylphenoxy)-butyl]-2-naphthamide
(C2) 2,4-Dichloro-3-methyl-6-(2,4-di-tert-amylphenoxyacetamido)phenol
(C3) 2,4-Dichloro-3-methyl-6-[α-(2,4-di-tert-amylphenoxy)butylamido]phenol
(C4) 1-Hydroxy-4-(3-nitrophenylsulfonamido)-N-[δ-(2,4-di-tert-amylphenoxy)butyl]-2-naphthamide
(C5) 1-hydroxy-4-[(β-methoxyethyl)carbamoyl]methoxy-N-[δ-(2,4-di-tert-amylphenoxy)butyl]-2-naphthamide
(C6) 1-Hydroxy-4-(isopropylcarbamoyl)methoxy-N-dodecyl-2-naphthamide
(C7) 2-Perfluorobutylamido-5-[α-(2,4-di-tert-amylphenoxy)hexanamido]phenol
(C8) 1-Hydroxy-4-(4-nitrophenylcarbamoyl)oxy-N-[δ-(2,4-di-tert-amylphenoxy)butyl]-2-naphthamide
(C9) 2-(5-Hydroperfluoropentanamido)-5-[α-(2,4,-di-tert-amylphenoxy)hexanamido]phenol In addition to these couplers exemplified above, colored magenta couplers and colored cyan couplers are also advantageously usable in the present invention.

The photosensitive materials of the present invention can contan development inhibitor-releasing type couplers (so-called DIR couplers) or development inhibitor-releasing substances, i.e. so-called DIR substances for the purpose of improving properties of the resulting photographic images, such as sharpness, graininess, etc. These couplers or substances may be used either alone or in combination. Similarly, so-called wise couplers can be used for adjustment of gradation as well as prevention of fogging.

The above-mentioned couplers and DIR substances can be incorporated into the photosensitive materials according to the well-known techniques usually employed in the field of photographic couplers.

Generally, hydroquinone type compounds can be used as stain preventives which are used for the prevention of fog or stain often caused by unnecessary reaction brought about between oxidized developing agent resulting from air oxidation and couplers.

The photosensitive materials of the present invention can be subjected to film hardening treatment according to the usual method. As hardeners used for the above purpose, there may be mentioned such aldehyde compounds as glutaldehyde, vinylsulfonyl type compounds, isocyanate type compounds, acryloyl type compounds, chlorotriazine type compounds, ethyleneimine type compounds and epoxy type compounds.

The photosensitive materials of the present invention can contain, if necessary, fluorescent whitening agents in constituent layers thereof. Typical fluorescent whitening agents usable for the purpose are diaminostilbene type compounds.

The photosensitive materials of the present invention are prepared by coating on a support the aforesaid silver halide emulsion layers and other layers into which such various photographic additives as mentioned above have been incorporated if necessary. Advantageously usable supports include such films as obtained, for example, from cellulose acetate, cellulose nitrate, polyvinyl acetal, polypropylene, polyester such as polyethylene terephthalate, and polystyrene. These support films are suitably selected according to the purpose for which the desired photosensitive material is used. If necessary, these supports are subjected to subbing treatment.

No particular limitation is placed on the method of processing the photosensitive materials of the present invention, and any of known treatment procedures can be employed. The exposed photosensitive materials are typically processed, for example, by a sequence of steps involving color development and bleach-fixing, followed, if necessary, by water-washing and stabilization; steps involving color development, bleaching, and fixing, followed, if necessary, by water-washing and stabilization; steps involving pre-hardening, neutralization, color development, stop fixing, water-washing, bleaching, fixing, water-washing, post-hardening and water-washing; and steps involving color development, water-washing, complementary color development, stopping, bleaching, fixing, water-washing and stabilization. Alternatively, the present photosensitive materials, after exposure, may be processed by any of such development process wherein after subjecting the developed silver formed by color development to halogenation bleaching, the thus treated photosensitive material is again allowed to undergo color development, and such treatment procedure wherein silver-saving type photosensitive materials are processed with such amplifying agents as peroxides or cobalt complex salts.

Compounds of the p-phenylenediamine classes are typical of the color developing agent.

The color developing agent may be used by incorporating it into photosensitive color photographic materials. Precursors of the color developing agent used in the present invention are Schiff base derivatives of color developing agents disclosed in U.S. Pat. Nos. 2,507,114, 2,695,234 and 3,342,599, and Research Disclosures, Vol. 151, No. 15159, Nov. 1979, and those disclosed in Research Disclosures, Vol. 129, No. 12924, Oct. 1976 and Vol. 139, No. 13924, Nov. 1975.

Color developers used in the processing of the present photosensitive materials may be incorporated, if necessary, with various appropriate additives.

Bleaching agents used in bleaching solution and bleach-fixing solution may be any of those which are serviciable as silver-oxidizing agents, for example, such ferricyanides as potassium ferricyanide and sodium ferricyanide, such persulfates as ammonium persulfate, ferric chloride, and metallic complex salts of organic acid. Preferably usable as bleaching agents in the processing of the present photosensitive materials are the metallic complex salts of organic acid with which have many advantages as oxidizing agents. The organic acid which forms these organometallic complex salts can be aminopolycarboxylic acid, and the salts of the aminopolycarboxylic acid may be alkali metal salts, ammonium salts or water-soluble amine salts.

The processing time and temperature employed in the above-mentioned bleaching and bleach-fixing treatments can be suitably selected according to the kind of photosensitive material to be processed and the purpose for which the photosensitive material is used. However, the effect of the present invention is markedly exhibited in a high temperature and quick treatment effected at above 30° C. for a period of within 20 minutes, particularly preferably at 35° C. or above for a period of within 10 minutes, using a bleaching solution containing preferably an organometallic complex salt as a bleaching agent.

The present invention is illustrated below with reference to examples, but it is to be understood that the invention is by no means limited to those examples.

EXAMPLE 1

High speed multilayer color negative photosensitive materials (Sample 1-6) were prepared by coating the following layers in the order recited on a transparent cellulose triacetate film support.

1st layer: Antihalation layer

An aqueous gelatin solution containing black colloidal silver and the undermentioned dispersion A was coated on the support at a silver coverage of 0.3 g/m$^2$ and a coverage of 0.32 g/m$^2$ of an oily drop component of the dispersion A. (Dry film thickness 3.5$\mu$)

Dispersion A

The dispersion was prepared by dissolving 9 g of a 2:1:1:1 mixture of ultraviolet absorbing compounds (A), (B), (C) and (D), particulars of which are as recited below, at 65° C. in a mixture of 15 g of dioctyl phthalate and 6 g of ethyl acetate. The resulting solution was incorporated into 100 cc of a 5% aqueous gelatin solution containing 1 g of sodium triisopropylnaphthalenesulfonate kept at 50° C., followed by dispersing with a colloid mill.

Compound (A)

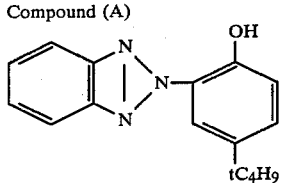

Compound (B)

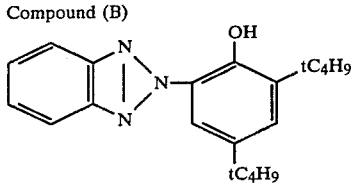

Compound (C)

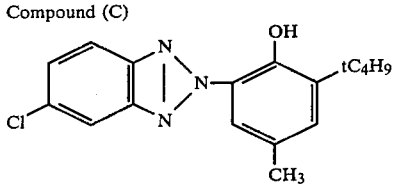

Compound (D)

-continued

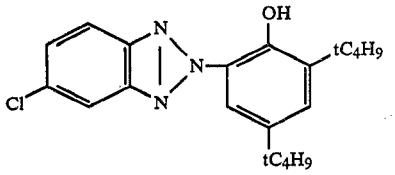

The compounds (A), (B), (C) and (D) are Tinuvin PS, 320, 326, and 327, respectively, which are trade names of ultraviolet absorbers produced and sold by Chiba-Geigy.

2nd-layer: Intermediate layer

An aqueous gelatin solution was coated on the 1st layer. (Dry film thickness 1μ)

3rd layer: Red-sensitive low speed silver halide emulsion layer

A mixture comprising, per 1 mole of silver halide, 60 g of 1-hydroxy-N-[δ-(2,4-di-tert-amylphenoxy)butyl]-2-naphthamide as a cyan coupler, 4 g of 1-hydroxy-4-[4-(1-hydroxy-δ-acetamido-3,6-disulfo-2-naphthylazo)-phenoxy]-N-[δ-(2,4-di-t-amylphenoxy)butyl]-2-naphthamide disodium salt as a colored coupler, and 2.8 g of 2-(1-phenyl-5-tetrazolylthio)-4-octadecylsuccinimido-1-indanone as a DIR substance was mixed with tricresyl phosphate as a high boiling solvent of the same weight as that of the couplers. The resulting mixture was dissolved in ethyl acetate and the resulting solution was mixed with an aqueous solution of Alkanol B (produced and sold by Du Pont) and an aqueous gelatin solution, followed by dispersing with a colloid mill to obtain a dispersion. A silver iodobromide emulsion containing the thus obtained dispersion was coated at a silver coverage of 2.0 g/m$^2$ on the 2nd layer. (Dry film thickness 4μ)

The emulsion used above is a 2:1 mixture of a silver iodobromide emulsion having an average crystal size of 0.6μ and containing 4 mol% of silver iodide and a silver iodobromide emulsion having an average crystal size of 0.3μ and containing 4 mol% of silver iodide, said mixture being optically sensitized with anhydro-5,5'-dichloro-9-ethyl-3,3'-di-(3-sulfopropyl)-thiacarbocyanine hydroxide and anhydro-9-ethyl-3,3'-di-(3-sulfopropyl)-4,5,4',5'-dibenzothiacarbocyanine hydroxide.

4th layer: Red-sensitive high speed silver halide emulsion layer

A mixture comprising, per 1 mole of silver halide, 15 g of 1-hydroxy-4-(isopropylcarbamoyl)-methoxy-N-dodecyl-2-naphthamide as a cyan coupler, 1.5 g of 1-hydroxy-4-[4-(1-hydroxy-δ-acetamido-3,6-disulfo-2-naphthylazo)phenoxy]-N-[δ-(2,4-di-t-amylphenoxy)-butyl]-2-naphthamide disodium salt as a colored coupler, and 2.1 g of 2-(1-phenyl-5-tetrazolylthio)-4-octadecylsuccinimido-1-indanone as a DIR substance was mixed with tricresyl phosphate as a high boiling solvent of the same weight as that of the couplers. The resulting mixture was dissolved in ethyl acetate, and the resulting solution was dispersed in the same manner as in the case of the 3rd layer to obtain a dispersion. A silver iodobromide emulsion containing the thus obtained dispersion was coated at a silver coverage of 1.4 g/m$^2$ on the 3rd layer. (Dry film thickness 2μ)

The emulsion used above is a silver iodobromide emulsion having an average crystal size of 1.2μ and containing 7 mol% of silver iodide, said emulsion being optically sensitized with the same sensitizing dye as used in the 3rd layer.

5th layer: Intermediate layer

This layer is the same as that of the 2nd layer.

6th layer: Green-sensitive low speed silver halide emulsion layer

A mixture comprising, per 1 mole of silver halide, 48 g of 1-(2,4,6-trichlorophenyl)-3-[3-(2,4-di-t-amylphenoxyacetamido)benzamido]-5-pyrazolone as magenta coupler, 12 g of 1-(2,4,6-trichlorophenyl)-3-(2-chloro-5-octadecenylsuccinimidoanilino)-4-(4-hydroxyphenylazo)-5-pyrazolone as a colored coupler, and 1.8 g of 2-(1-phenyl-5-tetrazolylthio)-4-octadecylsuccinimido-1-indanone as a DIR compound was mixed with tricresyl phosphate as a high boiling solvent of the same weight as that of the couplers. The resulting mixture was dissolved in ethyl acetate, and the resulting solution was dispersed in the same manner as in the case of the 3rd layer to obtain a dispersion. A silver iodobromide emulsion containing the thus obtained dispersion was coated at a silver coverage of 1.7 g/m$^2$. (Dry film thickness 4μ)

The emulsion used above is a 2:1 mixture of a silver iodobromide emulsion having an average crystal size of 0.6μ and containing 4 mol% of silver iodide and a silver iodobromide emulsion having an average crystal size of 0.3μ and containing 7 mol% of silver iodide, said mixture being optically sensitized with anhydro-5,5'-dichloro-9-ethyl-3,3'-di-(3-sulfopropyl)oxacarbocyanine hydroxide, anhydro-5,5'-diphenyl-9-ethyl-3,3'-di-(3-sulfopropyl)oxacarbocyanine hydroxide and anhydro-9-ethyl-3,3'-di-(3-sulfopropyl)-5,6,5',6'-dibenzooxacarbocyanine hydroxide.

7th layer: Green-sensitive high speed silver halide emulsion layer

A mixture comprising, per 1 mole of silver halide, 21 g of 1-(2,4,6-trichlorophenyl)-3-[3-(2,4-di-t-aminophenoxyacetamido)benzamido]-5-pyrazolone as magenta coupler, 3 g of 1-(2,4,6-trichlorophenyl)-3-(2-chloro-5-octadecenylsuccinimidoanilino)-4-(4-hydroxyphenylazo)-5-pyrazolone as a colored coupler, and 1 g of 2-(1-phenyl-5-tetrazolylthio)-4-octadecylsuccinimido-1-indanone as a DIR compound was mixed with tricresyl phosphate as a high boiling solvent of the same weight as that of the couplers. The resulting mixture was dissolved in ethyl acetate, and the resulting solution was dispersed in the same manner as in the case of the 3rd layer to obtain a dispersion. A silver iodobromide emulsion containing the thus obtained dispersion was coated at a silver coverage of 1.2 g/m$^2$ on the 6th layer. (Dry film thickness 1.8μ)

The emulsion used above is a silver iodobromide emulsion having an average crystal size of 1.2μ and containing 7 mol% of silver iodide, said emulsion being optically sensitized with the same sensitizing dyes as used in the 6th layer.

8th layer: Intermediate layer

This layer is the same as that of the 2nd layer.

9th layer: Yellow filter layer

An aqueous gelatin solution containing a dispersion product of 2,5-di-t-octylhydroquinone and 0.1 g/m$^2$ of yellow colloidal silver was coated on the 8th layer.

10th layer: Blue-sensitive low speed silver halide emulsion layer

A mixture comprising 200 g, per mole of silver halide, of α-[(1-benzyl-2-phenyl-3,5-dioxo-1,2,4-triazolidinyl)]-α-pivalyl-2-chloro-5-(δ-(2,4-di-t-amylphenoxy)-butylamido]acetanilide as yellow coupler and dibutyl phthalate as a high boiling solvent of the same weight as that of the coupler was dissolved in ethyl acetate, and the resulting solution was dispersed in the same manner as in the case of the 3rd layer. A silver iodobromide emulsion containing the thus obtained dispersion was coated at a silver coverage of 0.7 g/m$^2$ on the 9th layer. (Dry film thickness 4$\mu$)

The emulsion used above is a silver iodobromide emulsion having an average crystal size of 0.6$\mu$ and containing 8 mol% of silver iodide, said emulsion eing optically sensitized with anhydro-3,3'-di-(3-sulfopropyl)-selenacyanine hydroxide.

11th layer: Blue-sensitive high speed silver halide emulsion layer

A silver iodobromide emulsion containing 130 g, per 1 mole of silver halide, of the same coupler as that of the 10th layer as yellow coupler was coated at a silver coverage of 0.5 g/m$^2$ on the 10th layer. (Dry film thickness 3$\mu$)

The emulsion used above is a silver iodobromide emulsion having an average crystal size of 1.2$\mu$ and containing 7 mol% of silver iodide, said emulsion being optically sensitized with the same sensitizing dye as used in the 10th layer.

12th layer: Intermediate layer

An aqueous gelatin solution containing the dispersion A of the 1st layer was coated at a coverage of 0.32 g/m$^2$ as the oily component of the dispersion A. (Dry film thickness 1.2$\mu$)

13th layer: Protective layer

An aqueous gelatin solution containing silica having an average particle size of 5$\mu$ as a matting agent, a slipping agent and organofluoro compound (2) was coated on the 12th layer at a silica coverage of 0.02 g/m$^2$, slipping agent coverage of 0.04 g/m$^2$ and organofluoro compound coverage of 5 mg/m$^2$. (Dry film thickness 0.5$\mu$)

Slipping agent (1)

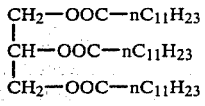

Organofluoro compound (2)

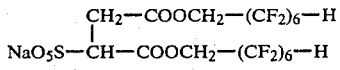

The high speed multilayer color negative photosensitive material thus prepared was designated Comparative sample (Sample 1).

Subsequently, Comparative sample (Sample 2) was prepared in the same manner as in the case of Sample 1, except that the undermentioned backing layer (14th layer) was provided on the reverse side of the support.

14th layer: Backing layer

A gelatin solution containing silica having an average particle size of 5$\mu$ and colloidal silica as matting agents, and the undermentioned dyes [I], [II] and [III] was coated on the reverse side of support at a silica coverage of 0.02 g/m$^2$, colloidal silica coverage of 0.06 g/m$^2$, dye coverage of 0.2 g/m$^2$ and gelatin coverage of 5 g/m$^2$.

Dye [I]

-continued

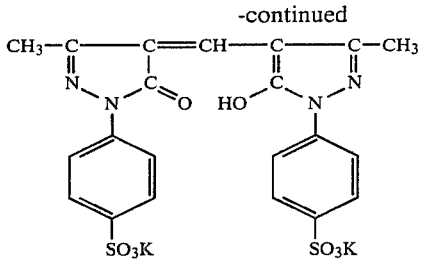

Dye [II]

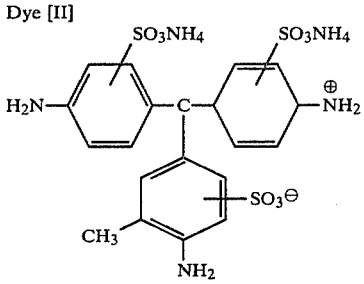

Dye [III]

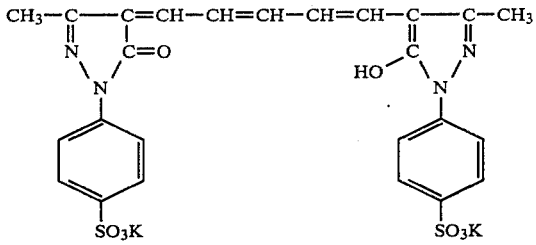

Subsequently, Sample 3 was prepared in the same manner as in the case of Comparative sample 2, except that the 1st layer, i.e. antihalation layer containing black colloidal silver and dispersion A, was coated at a silver coverage of 0.18 g/m$^2$ on the support, and the 3rd, 4th and 6th layers were coated in like manner but at silver coverages of 1.5 g/m$^2$, 1.0 g/m$^2$ and 1.4 g/m$^2$, respectively.

Subsequently, Comparative sample (Sample 4) was prepared in the same manner as in the case of Comparative sample 1, except that a non-photosensitive intermediate layer (15th layer) containing the undermentioned dispersion is provided between the 3rd and 4th layers, which are both red-sensitive silver halide emulsion layers, and the 3rd and 4th layers were coated in like manner but at silver coverages of 2.8 g/m$^2$ and 2.0 g/m$^2$, respectively.

Non-photosensitive intermediate layer (15th layer)

A mixture of 5g of cyan coupler 1-hydroxy-4-[$\beta$-methoxyethylaminocarbonylmethoxy]-N-[$\delta$-(2,4-di-t-amylphenoxy)butyl]-2-naphthamide and 50 mg of DIR compound 2-(1-phenyl-5-tetrazolylthio)-4-octadecylsuccinimido-1-indanone in tricresyl phosphate as a high boiling solvent was dissolved in ethyl acetate, and the resulting solution was dispersed in the same manner as in the case of the 3rd layer. A gelatin solution containing the thus obtained dispersion was coated on the 3rd layer so as to form a leyr having a dry film thickness of 1.2$\mu$.

Subsequently, Sample 5 was prepared in the same manner as in the case of Comparative sample 1, except that the 1st layer, i.e. antihalation layer containing black colloidal silver and dispersion A, was coated at a silver coverage of 0.18 g/m$^2$ on the support.

Subsequently, Sample 6 was prepared in the same manner as in the case of Comparative sample 4, except that the 1st layer, i.e. antihalation layer was coated at a silver coverage of 0.18 g/m$^2$ on the support.

Subsequently, Sample 7 was prepared in the same manner as in the case of Sample 2, except that the 1st layer, i.e. antihalation layer was coated at a silver coverage of 0.18 g/m$^2$ on the support.

Subsequently, Sample 8 was prepared in the same manner as in the case of Sample 6, except that the above-mentioned backing layer was provided on the reverse side of support.

The comparative samples and samples thus obtained were subjected to color development treatment, after exposure to light in accordance with the procedure described in ISO No. 5800, following the undermentioned treatment steps.

| [Treatment step] | [37.8° C.] | [Treatment time] |
|---|---|---|
| 1. Color development | | 3 min. 15 sec. |
| 2. Bleaching | | 6 min. 30 sec. |
| 3. Water-washing | | 3 min. 15 sec. |
| 4. Fixing | | 6 min. 30 sec. |
| 5. Water-washing | | 3 min. 15 sec. |
| 6. Stabilization | | 1 min. 30 sec. |
| 7. Drying | | |

| Composition of color developer: | |
|---|---|
| 4-Amino-3-methyl-N—ethyl-N—(β-hydroxyethyl)-aniline sulfate | 4.8 g |
| Anhydrous sodium sulfite | 0.14 g |
| Hydroxylamine ½ sulfate | 1.98 g |
| Sulfuric acid | 0.74 g |
| Anhydrous potassium carbonate | 28.85 g |
| Anhydrous potassium hydrogen-carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| Water to make 1 liter | |
| Composition of bleaching solution: | |
| Ferric ammonium salt of ethylene-diaminetetraacetic acid | 100.0 g |
| Diammonium salt of ethylene-diaminetetraacetic acid | 10.0 g |
| Ammonium bromide | 150.0 g |
| Glacial acetic acid | 10.0 ml |
| Water to make 1 liter and adjust to pH 6.0 with ammonia water | |
| Composition of fixing solution: | |
| Ammonium thiosulfate | 175.0 g |
| Anhydrous sodium sulfite | 8.6 g |
| Sodium metasulfite | 2.3 g |
| Water to make 1 liter and adjust to pH 6.0 with acetic acid | |
| Composition of stabilizing solution: | |
| Formalin | 1.5 ml |
| Konidax (produced and sold by Konishiroku Photo Industry Co., Ltd.) | 7.5 ml |
| Water to make 1 liter | |

Subsequently, color images individually formed on the above-mentioned samples were tested for sensitivity, graininess and sharpness of the images. The sensitivity was obtained as ISO speed as measured according to the procedure described in ISO No. 5800.

Image graininess (RMS) was represented by a value 1000 times the standard deviation of variation of density value by scanning the image with a microdensitometer having a circular scan aperture of 2.5μ.

Image sharpness was determined by obtaining a response function (Modulation Transfer Function: hereinafter called MTF) and effecting a comparison in largeness of MTF values as measured at certain varying space frequency levels. Measurement of MTF was conducted according to the procedure described in Ikuo Fujimura, "Non-Rupture Tests", Vol. 16, p. 472–482 (1967).

Desilverizing rate was obtained by effecting bleaching treatment with the aforementioned bleaching solution for 2 min. 10 sec., 4 min. 20 sec. and 6 min. 30 sec., respectively, and measuring amounts of residual silver, after completion of the treatment, in the processed photosensitive material by means of a fluorescent X-ray measurement machine.

The results obtained in the above-mentioned tests are shown in Table 1.

TABLE 1

| Sample No. | Total amount of silver in emulsion layers g/m$^2$ | Amount of silver in anti-halation layer g/m$^2$ | Existence of backing gum | ISO Sensitivity | RMS Value | MTF value (%) 10 pc./mm | MTF value (%) 30 pc./mm | Desilverization (mg/m$^2$) Bleaching time 2 min 10 sec | 4 min 20 sec | 6 min 30 sec |
|---|---|---|---|---|---|---|---|---|---|---|
| 1 (Comparative) | 7.5 | 0.3 | None | 100 | 63 | 83 | 47 | 32 | 24 | 12 |
| 2 (Comparative) | 7.5 | 0.3 | Existed | 100 | 63 | 84 | 49 | 32 | 24 | 12 |
| 3 (Comparative) | 6.3 | 0.18 | Existed | 80 | 70 | 82 | 46 | 17 | 5 | 0 |
| 4 (Comparative) | 8.4 | 0.3 | None | 160 | 45 | 82 | 49 | 73 | 44 | 38 |
| 5 (Comparative) | 7.5 | 0.18 | " | 100 | 60 | 64 | 18 | 18 | 6 | 0 |
| 6 (Comparative) | 8.4 | 0.18 | " | 160 | 45 | 61 | 21 | 19 | 7 | 0 |
| 7 (Present invention) | 7.5 | 0.18 | Existed | 100 | 55 | 87 | 52 | 19 | 5 | 0 |
| 8 (Present | 8.4 | 0.18 | Existed | 160 | 40 | 86 | 51 | 19 | 6 | 0 |

TABLE 1-continued

| Sample No. | Total amount of silver in emulsion layers g/m² | Amount of silver in anti-halation layer g/m² | Existence of backing gum | ISO Sensitivity | RMS Value | MTF value (%) 10 pc./mm | MTF value (%) 30 pc./mm | Desilverization (mg/m²) Bleaching time 2 min 10 sec | 4 min 20 sec | 6 min 30 sec |
|---|---|---|---|---|---|---|---|---|---|---|
| invention) | | | | | | | | | | |

As is clear from Table 1, in comparison with Comparative samples 1–6, the present samples 7 and 8 showed excellent characteristics with respect to sharpness and desilverizing property without marring sensitivity. In particular, the present sample 8 was found to be a high speed and finegrainificated color negative photographic film having particularly excellent characteristics with respect to sensitivity, graininess and sharpness.

EXAMPLE 2

High speed multilayer color negative photosensitive materials (Sample 9 and 10) were prepared in the same manner as Example 1.

Sample 9 was prepared in the same manner as in the case of Sample 7 of Example 1, except that the 3rd and 4th layers, which are both red-sensitive silver halide emulsion layers, were coated in like manner but at silver coverages of 2.8 g/m² and 2.0 g/m², respectively.

Subsequently, Sample 10 was prepared in the same manner as in the case of Sample 7, except that the undermentioned red-sensitive silver halide emulsion layer (16th layer) is provided between the 3rd and 4th layers.

16th layer: Red-sensitive medium speed silver halide emulsion layer

A mixture comprising, per 1 mole of silver halide, 10 g of 1-hydroxy-N-[δ-(2,4-di-tert-amylphenoxy)butyl]-2-naphthamide as a cyan coupler, 0.5 g of 1-hydroxy-4-[4-(1-hydroxy-δ-acetamido-3,6-disulfo-2-naphthylazo)-phenoxy]-N-[δ-(2,4-ditert-amylphenoxy)butyl]-2-naphthamide disodium salt as a colored coupler, and 0.5 g of 2-(1-phenyl-5-tetrazolylthio)-4-octadecylsuccinimido-1-indanone as a DIR substance was mixed with tricresyl phosphate as a high boiling solvent of the same weight as that of the couplers. The resulting mixture was dissolved in ethyl acetate, and the resulting solution was dispersed in the same manner as in the case of the 3rd layer to obtain a dispersion. A silver iodobromide emulsion containing the thus obtained dispersion was coated at a silver coverage of 0.9 g/m² on the 3rd layer. (Dry film thickness 1μ).

The emulsion used above is a 2:1 mixture of a silver iodobromide emulsion having an average crystal size of 0.75μ and containing 4 mol% of silver iodide and a silver iodobromide emulsion having an average crystal size of 0.45μ containing 4 mol% of silver iodide, said mixture being optically sensitized with the same sensitizing dye as used in the 3rd layer.

These samples thus obtained were exposed and subjected to color development treatment in the same manner as Example 1.

The same estimations as Example 1 were carried out, and the results obtained are shown in Table 2.

TABLE 2

| Sample No. | Total amount of silver in emulsion layers g/m² | Amount of silver in anti-halation layer g/m² | Existence of backing gum | ISO Sensitivity | RMS Value | MTF value (%) 10 pc./mm | MTF value (%) 30 pc./mm | Desilverization (mg/m²) Bleaching time 2 min 10 sec | 4 min 20 sec | 6 min 30 sec |
|---|---|---|---|---|---|---|---|---|---|---|
| 9 (Present invention) | 8.4 | 0.18 | Existed | 125 | 59 | 79 | 49 | 20 | 6 | 0 |
| 10 (Present invention) | 8.4 | 0.18 | Existed | 125 | 47 | 86 | 51 | 19 | 6 | 0 |

As apparent from Table 2, the photosensitive materials of the present invention have excellent performances.

EXAMPLE 3

Multilayer color reversal photosensitive materials (Samples Nos. 11–13) were prepared by coating the following layers in the order recited on a transparent polyethylene terephthalate film support.

1st layer: Antihalation layer

An aqueous gelatin solution containing black colloidal silver was coated on the surface of support at a silver coverage of 0.3 g/m² so as to form a layer having a dry film thickness of 3μ.

2nd layer: Intermediate layer

An aqueous gelatin solution was coated on the 1st layer so as to form a layer having a dry film thickness of 1μ.

3rd layer: Red-sensitive low speed silver halide emulsion layer

A silver iodobromide emulsion containing, per mole of silver halide, 25 g of 1-hydroxy-N-[δ-(2,4 -di-t-amylphenoxy) butyl]-2-naphthamide as cyan coupler was coated (dry film thickness 4μ) at a silver coverage of 2.5 g/m² on the 2nd layer.

The emulsion used above is a silver iodobromide emulsion containing 6 mol% of silver iodide and optically sensitized with anhydro-5,5'-dichloro-9-ethyl-3,3'- di-(3-sulfopropyl)thiacarbocyanine hydroxide and anhydro-9-ethyl-3,3'-di-(3-sulfopropyl)-4,5,4',5'-dibenzothiacarbocyanine hydroxide.

4th layer: Intermediate layer

An aqueous gelatin solution containing 2.5 g/m$^2$ of cyan coupler 1-hydroxy-N-[δ-(2,4-di-t-amylphenoxy)-butyl]-2-naphthamide was coated to a dry film thickness of 4μ on the 3rd layer.

5th layer: Red-sensitive high speed silver halide emulsion layer

A silver iodobromide emulsion containing 25 g, per mole of silver halide, of 1-hydroxy-N-[δ-(2,4-di-t-amylphenoxy) butyl]-2-naphthamide was coated at a silver coverage of 1.7 g/m$^2$ to a dry film thickness of 2μ on the 4th layer.

The emulsion used above is a silver iodobromide emulsion containing 6 mol% of silver iodide and optically sensitized with the same sensitizing dyes as used in the 3rd layer.

6th layer: Intermediate layer

This layer is the same as the 2nd layer.

7th layer: Green-sensitive low speed silver halide emulsion layer

A silver iodobromide emulsion containing 30 g, per mole of silver halide, of 1-(2,4,6-trichlorophenyl)-3-[3-(2,4-di-t-amylphenoxyacetamido)benzamido]-5-pyrazolone as magenta coupler was coated at a silver coverage of 1.6 g/m$^2$ to a dry film thickness of 4μ on the 6th layer.

The emulsion used above is a silver iodobromide emulsion containing 6 mol% of silver iodide and optically sensitized with anhydro-5,5'-diphenyl-9-ethyl-3,3'-di-(3-sulfopropyl) oxacarbocyanine hydroxide and anhydro-5,5',6,6'-tetra-chloro-1,1'-di-ethyl-3,3'-di-(3-sulfopropyl)imidacarbocyanine hydroxide.

8th layer: Green-sensitive high speed silver halide emulsion layer

A silver iodobromide emulsion containing 30 g, per mole of silver halide, of 1-(2,4,6-trichlorophenyl)-3-[3-(2,4-di-t-amylphenoxyacetamide)benzamido]-5-pyrazolone as magenta coupler was coated at a silver coverage of 1.4 g/m$^2$ to a dry film thickness of 1.8μ on the 7th layer.

The emulsion used above is a silver iodobromide emulsion containing 6 mol% of silver iodide and optically sensitized with the same sensitizing dye as used in the 7th layer.

9th layer: Intermediate layer

This layer is the same as the 2nd layer.

10th layer: Yellow filter layer

An aqueous gelatin solution containing yellow colloidal silver was coated at a silver coverage of 0.1 g/m$^2$ to a dry film thickness of 1.3μ on the 9th layer.

11th layer: Blue-sensitive low speed silver halide emulsion layer

A silver iodobromide emulsion containing 90 g, per mole of silver halide, of α-[4-(1-benzyl-2-phenyl-3,5-dioxo-1,2,4-triazolidinyl)]-α-pivalyl-2-chloro-5-[γ-(2,4,-di-t-amylphenoxy) butylamido]acetanilide as yellow coupler was coated at a silver coverage of 0.6 g/m$^2$ to a dry film thickness of 4.0μ on the 10th layer.

The emulsion used above is a silver iodobromide emulsion containing 6 mol% of silver iodide and optically sensitized with anhydro-3,3'-di-(3-sulfopropyl)-selenacyanine hydroxide.

12th layer: Blue-sensitive high speed silver halide emulsion layer

A silver iodobromide emulsion containing 90 g, per mole of silver halide, of α-[4-(1-benzyl-2-phenyl-3,5-dioxo-1,2,4-triazolidinyl)]-α-pivalyl-2-chloro-5-[γ-(2,4-di-t-amylphenoxy) butylamido]acetanilide as yellow coupler was coated at a silver coverage of 0.8 g/m$^2$ to a dry film thickness of 3μ on the 11th layer. The emulsion used above is a silver iodobromide emulsion containing 6 mol% of silver iodide and optically sensitized with the same sensitizing dye as in the 11th layer.

13th layer: Protective layer

An aqueous gelatin solution was coated at a gelatin coverage of 1.3 g/m$^2$ to a dry film thickness of 1.2μ on the 12th layer.

The multilayer color reversal photosensitive material thus prepared was designated Comparative sample (Sample 11).

Subsequently, Sample 12 was prepared in the same manner as in the case of Comparative sample (Sample 11), except that the antihalation layer was formed by coating a black colloidal silver-containing aqueous gelatin solution at a silver coverage of 0.18 g/m$^2$ on the surface of support.

Subsequently, Sample 13 was prepared in the same manner as in the case Sample 12, except that the backing layer as indicated in Example 1 was provided on the reverse side of support.

The Comparative samples (Samples 11 and 12) and Sample 13 of the present invention were exposed to light according to the procedure described in ISO No. 2240 and then subjected to color development treatment in the manner as mentioned below.

| [Treatment step] | [Temperature] | [Treatment time] |
|---|---|---|
| First development | 38° C. | 6 min. |
| First water-washing | 38° C. | 2 min. |
| Reversing | 38° C. | 2 min. |
| Color development | 38° C. | 6 min. |
| Adjusting | 38° C. | 2 min. |
| Bleaching | 38° C. | 6 min. |
| Fixing | 38° C. | 4 min. |
| Final water-washing | 38° C. | 4 min. |
| Stabilization | 38° C. | 30 sec. |
| Drying | 50° C. | |

Processing solutions used in the above-mentioned treatment steps have their respective constituents as mentioned below.

| | |
|---|---|
| First developer: | |
| Pentasodium nitrilo-N,N,N—trimethylene-sulfonate (45% aq. soln.) | 1.0 ml |
| Potassium sulfite dihydrate | 35.0 g |
| Sodium bromide | 2.2 g |
| Sodium thiocyanate | 1.0 g |
| Potassium iodide | 4.5 mg |
| Potassium hydroxide | 4.5 g |
| Diethylene glycol | 12.0 ml |
| 1-Phenyl-4-hydroxymethyl-3-pyrazolidone | 1.5 g |
| Anhydrous potassium carbonate | 14.0 g |
| Sodium bicarbonate | 12.0 g |
| Potassium hydroquinonesulfonate | 22.0 g |
| Water to make | 1 liter |
| Adjusted to pH 9.6 | |
| Reversing solution: | |
| Anhydrous sodium acetate | 10.0 g |
| Anhydrous stannous chloride | 1.5 g |
| Hydroxylamine sulfate | 0.1 g |
| Sodium hydroxide | 10.0 g |
| Citric acid monohydrate | 20.0 |
| Water to make | 1 liter |
| Adjusted to pH 5.8 | |

-continued

| | |
|---|---|
| Color developer: | |
| Pentasodium nitrilo-N,N,N—trimethylenephosphonate (45% aq. soln.) | 5.0 ml |
| Phosphoric acid (85%) | 7.0 ml |
| Sodium bromide | 0.7 g |
| Potassium iodide | 30.0 mg |
| Potassium hydroxide | 20.0 g |
| Anhydrous sodium sulfite | 4.5 g |
| 4-Amino-N—ethyl-N—(β-methanesulfonamidoethyl)-m-toluidine sesquisulfate hydrate | 11.0 g |
| 1,8-Hydroxy-3,6-dithiaoctane | 1.0 g |
| Water to make | 1 liter |
| Adjusted to pH 11.7 | |
| Adjusting solution: | |
| Potassium sulfite | 15.0 g |
| Ethylenediaminetetraacetic acid | 8.0 g |
| α-Monothioglycerol | 0.5 ml |
| Water to make | 1 liter |
| Adjusted to pH 6.2 | |
| Bleaching solution: | |
| Potassium nitrate | 25.0 g |
| Potassium bromide | 80.0 g |
| Triammonium salt of ethylenediaminetetraacetic acid | 110.0 g |
| Hydrobromic acid (48%) | 30.0 ml |
| Ethylenediamineacetic acid | 4.0 g |
| Water to make | 1 liter |
| Adjusted to pH 5.7 | |
| Fixing solution: | |
| Ammonium thiosulfate | 55.0 g |
| Disodium ethylenediaminetetraacetate | 0.8 g |
| Sodium metabisulfite | 7.5 g |
| Sodium hydroxide | 1.5 g |
| Water to make | 1 liter |
| Adjusted to pH 6.6 | |
| Stabilizer: | |
| Formalin (35%) | 6.0 ml |
| Konidax (produced and sold by Konishiroku Photo Industry Co., Ltd.) | 7.5 ml |
| Water to make | 1 liter |

The thus processed samples were tested for sensitivity in accordance with the procedure described in ISO No. 2240, and for graininess, sharpness and desilverizing property in accordance with the procedures described in Example 1. The results obtained are shown in Table 3. As is also the case with Example 1, when compared with Comparative samples 11 and 12, the present sample 13 is a highly sensitized color reversal photosensitive material with excellent desilverizing property and sharpness.

TABLE 3

| Sample No. | Total amount of silver in emulsion layers g/m² | Amount of silver in anti-halation layer g/m² | Presence of backing gum | ISO Sensitivity | RMS Value | MTF value (%) 10 pc./mm | MTF value (%) 30 pc./mm | Desilverization (mg/m²) Bleaching time 2 min | 4 min | 6 min |
|---|---|---|---|---|---|---|---|---|---|---|
| 11 (Comparative) | 8.6 | 0.3 | None | 125 | 46 | 81 | 46 | 63 | 39 | 32 |
| 12 (Comparative) | 8.6 | 0.18 | None | 125 | 47 | 63 | 21 | 25 | 9 | 1 |
| 13 (Present invention) | 8.6 | 0.18 | Existed | 125 | 43 | 83 | 49 | 23 | 8 | 1 |

What we claim is:

1. A photosensitive silver halide color photographic material comprising a support having a first and second surface, said first surface having thereon an anti-halation layer, a red-sensitive silver halide emulsion layer, a green-sensitive silver halide emulsion layer and a blue-sensitive silver halide emulsion layer, each of said silver halide emulsion layers containing a non-diffusible coupler, said second surface of the support having thereon a dye-containing backing layer, wherein said anti-halation layer contains between 0.18 and 0.2 g/m² of silver and wherein the total amount of silver contained in said silver halide emulsion layers is at least 7.0 g/m².

2. The photosensitive silver halide color photographic material according to claim 1 wherein at least one of the blue-sensitive, green-sensitive and red-sensitive silver halide emulsion layers comprises at least two photosensitive emulsion layers.

3. The photosensitive silver halide color photographic material according to claim 1 wherein at least one of the blue-sensitive, green-sensitive and red-sensitive silver halide emulsion layers comprises at least three photosensitive layers.

4. The photosensitive silver halide color photographic material according to claim 1 wherein the silver halide contained in said silver halide emulsion layers is dispersed in a binder.

5. The photosensitive silver halide color photographic material according to claim 2 wherein the silver halide contained in said silver halide emulsion layers is dispersed in a binder.

6. The photosensitive silver halide color photographic material according to claim 1 wherein the total amount of silver contained in said silver halide emulsion layers is between 7.5 and 8.6 g/m².

7. The photosensitive silver halide color photographic material according to claim 2 wherein the total amount of silver contained in said silver halide emulsion layers is between 7.5 and 8.6 g/m².

8. The photosensitive silver halide color photographic material according to claim 4 wherein the total amount of silver contained in said silver halide emulsion layers is between 7.5 and 8.6 g/m².

* * * * *